US005205347A

United States Patent [19]

Hughes

[11] Patent Number: 5,205,347

[45] Date of Patent: Apr. 27, 1993

[54] HIGH EFFICIENCY EVAPORATOR

[75] Inventor: Gregory G. Hughes, Milwaukee, Wis.

[73] Assignee: Modine Manufacturing Co., Racine, Wis.

[21] Appl. No.: 861,118

[22] Filed: Mar. 31, 1992

[51] Int. Cl.[5] ..... F28F 9/26

[52] U.S. Cl. ..... 165/1; 165/144; 165/174; 165/176; 62/526

[58] Field of Search ..... 62/524–526; 165/144, 145, 176–178

[56] References Cited

U.S. PATENT DOCUMENTS

| | | | |
|---|---|---|---|
| 709,051 | 9/1902 | Schneller | 165/174 |
| 1,673,409 | 6/1928 | Kelley | 165/174 |
| 2,124,291 | 7/1938 | Fleisher | 165/145 X |
| 2,184,657 | 12/1939 | Young | 165/145 |
| 3,601,186 | 8/1971 | Smith | 165/176 |
| 4,825,941 | 5/1989 | Hoshino et al. | 165/110 |
| 5,086,835 | 2/1992 | Shinmura | 165/144 |

FOREIGN PATENT DOCUMENTS

| | | | |
|---|---|---|---|
| 484577 | 3/1925 | Fed. Rep. of Germany | 165/176 |
| 1083060 | 3/1984 | U.S.S.R. | 165/176 |

*Primary Examiner*—Allen J. Flanigan

*Attorney, Agent, or Firm*—Wood, Phillips, VanSanten, Hoffman & Ertel

[57] ABSTRACT

Low efficiency in an evaporator for a refrigerant may be increased by providing the evaporator with at least two passes (10, 12) defined by two rows of tubes (20) and four elongated header passages (24, 26, 28, 30) with the header passages (24, 26) being in fluid communication with the tubes (20) in the pass (10) and the header passages (28, 30) being in fluid communication with the tubes (20) in the pass (12). The pass (10) is downstream from the pass (12) and includes an inlet (32) to the header passage (24) intermediate the ends thereof. An outlet (34) is located in the header passage (28) for the pass (12) and intermediate the ends thereof. At least one fluid passage (36) extends between the headers (26, 30) intermediate the ends thereof.

18 Claims, 3 Drawing Sheets

HIGH EFFICIENCY EVAPORATOR

FIELD OF THE INVENTION

This invention relates to heat exchangers, and more particularly, to headers utilized in heat exchangers. It also relates to a heat exchanger construction particularly useful in an evaporator.

BACKGROUND OF THE INVENTION

Many conventional heat exchangers of the type where ambient air is utilized as one heat transfer fluid include opposed headers interconnected by tubes. In the usual case, fins extend between the tubes. Air is caused to flow between the tubes and through the fins in a direction generally transverse thereto.

One measure of the ability of such a heat exchanger to exchange a given quantity of heat over a unit of time is the effective frontal area of the heat exchanger. This area is equal to the area of the entire heat exchanger normal to the path of airflow less that part of such area occupied by the headers and/or tanks conventionally associated therewith. Typically, this area is the frontal area of the so-called "core" which basically is the fin and tube assembly of the heat exchanger.

In some applications, size constraints may not be present and in such a case, the core may be built of sufficient size so as to provide the desired frontal area without regard for the additional volume occupied by the tanks and/or headers. In others, however, only a given area is available to receive the entire heat exchanger. In these cases, the core size must be maximized to maximize heat transfer ability. At the same time, because of size constraints, the volume of the tanks and/or headers may limit the size of the core and thus limit heat exchange ability.

One typical application in which size constraints are present is in vehicles. Because of increasing concern over the last decade or so for energy efficiency, vehicle manufacturers have sought to produce more aerodynamically designed vehicles with lower drag coefficients and this has produced constraints on the frontal area of the vehicles whereat heat exchangers such as radiators, condensers, evaporators, oil coolers and the like may be located. In addition, vehicle manufacturers have sought to reduce the weight of the various components utilized in the vehicle as a means of improving fuel utilization and heat exchangers have not been immune from the search for ways to reduce weight.

More recently, there has been increasing concern about the escape of chlorofluorocarbons or so-called CFCs or other potentially harmful cases into the atmosphere. One source of escaping CFCs is leaking refrigerant from an air-condition system. Clearly, if the refrigerant charge volume of a vapor compression refrigeration or air conditioning system can be reduced, then the consequences of a leak in any given system in terms of the amount of CFCs released to the atmosphere is lessened because of the lesser volume of CFCs in such a system.

Still another concern unique to air-conditioning or refrigeration systems is the efficiency of the evaporator utilized in a typical vapor compression refrigeration system. All too frequently, the temperature of a fluid stream passing through an evaporator varies widely from one location to another across the rear face of the evaporator. This is indicative of poor efficiency in the heat transfer operation which desirably would result in substantial uniformity of the temperature of the exiting airstream from one location on the evaporator to another. Such uniformity is indicative of a uniform temperature differential and good heat transfer efficiency.

It has long been postulated that these temperature differentials result from poor distribution of the refrigerant within the evaporator. Those parts of the evaporator receiving more refrigerant will run colder than those receiving less. Thus, elaborate distributor schemes have been devised in many attempts to achieve uniform distribution of refrigerant through the many passages of the evaporator. While such distributors work well in a number of instances, their complexity results in an expensive construction which in itself is not conducive to their use. The present invention is directed to solving one or more of the above as well as other problems.

SUMMARY OF THE INVENTION

It is the principal object of the invention to provide a new and improved evaporator for a refrigerant. More particularly, it is an object of the invention to provide an evaporator that achieves good distribution of refrigerant within the evaporator to achieve high efficiency heat transfer in an evaporation process and which is inexpensive and simple to fabricate, thus providing a low cost evaporator.

According to one facet of the invention, there is provided a high efficiency evaporator for a refrigerant that includes at least two elongated rows of tubes having opposed ends with the first of the rows defining the front of the evaporator and the last of the rows defining the rear of the evaporator. Means are provided to define at least four elongated header passages, two for each of the rows with one at each of the opposed tube ends in each of the rows and in fluid communication with the interiors of the tubes of the associated row. The header passages are at corresponding ends of the tubes in adjacent rows being adjacent to one another. An inlet is provided to one of the header passages in the last row at a location intermediate the ends thereof. An outlet is provided from another of the header passages in the first row and intermediate the ends thereof. Fluid passages extend between pairs of each of the remaining header passages and intermediate the ends thereof. Each of the pairs of remaining header passages is made up of two immediately adjacent header passages.

In a preferred embodiment, the inlet includes a refrigerant receiving passage extending generally normal to an impingement surface and adapted to receive a refrigerant to be evaporated. A pair of discharge openings are spaced 180° apart and at the intersection of the impingement surface and the receiving passage and are generally transverse to the receiving passage. The discharge openings face down opposite sides of the one header passage.

In one embodiment, the header passages are defined by tubes. Alternately, the header passages may be defined by laminations.

In a highly preferred embodiment, each of the fluid passages has an outlet from one header passage of a pair and an inlet to the other header passage of a pair. Each such inlet includes two diametrically opposite discharge openings intermediate the ends of the associated header passage and facing down opposite sides thereof.

In a highly preferred embodiment, the inlet is located at the midpoint of the one header passage.

It is also highly preferred that the fluid passages extend between the midpoints of the header passages in a pair.

The invention also contemplates an evaporator construction made up of two spaced header structures, each having two elongated interior header passages together with a plurality of flattened tubes extending between the header structures in two rows with each row being in fluid communication with a corresponding header passage in each header structure. A generally central inlet is provided to one of the header passages in one of the header structures and a generally central outlet from the other of the header passages in the one header structure is also provided. A generally central connecting passage extends between the header passages in the other of the header structures.

Preferably, the inlet is defined by a fitting have an axial passage terminating in an impingement surface and a radial passage terminating in opposed discharge openings. The impingement surface is part of the wall of the radial passage.

In one embodiment, the radial passage is of flattened cross-section. Preferably, the width of the radial passage is greater than the width of the axial passage.

The invention also contemplates a method of cooling an fluid stream which includes the steps of:

a) flowing the stream of fluid to be cooled in a particular path and a particular direction;
b) placing at least two elongated rows of tubes across the path;
c) introducing refrigerant at a reduced pressure into the tubes of a row that is downstream in relation to the particular direction from the center of the downstream row towards opposite ends thereof;
d) collecting the refrigerant as it emerges from the tubes of the downstream row and introducing it into the tubes in the immediately upstream row at its general center and towards opposite ends thereof;
e) sequentially repeating steps c) and d) until the refrigerant is passed through all of the rows; and
f) collecting the refrigerant as it emerges from the tubes of the most upstream row.

According to still another facet of the invention, there is provided a heat exchanger with an improved laminated header. Thus, in a heat exchanger of the type including a laminated header with a header plate having a header passage therein, a cover plate abutting the header plate on one side thereof and sealed thereto and a tube plate on the other side of the header plate and sealed thereto and having a plurality of tube receiving openings aligned with and in fluid communication with the header passage, and a plurality of tubes having open ends received in the openings in the tube plate in sealed relation therewith, the invention specifically contemplates the improvement of stop means at the interface of the tube plate and the header plate. The stop means include stop surfaces engagable with tubes in each of the openings in the tube plate for preventing the associated tube from extending through the opening in which it is received into the header passage.

Preferably, each stop surface is defined by a shoulder extending at least partially about a notch or opening. The notch or opening has the shape and size of the outer dimension of the corresponding tube, less the wall thickness of the corresponding tube.

In one embodiment, the stop surfaces are defined by a stop plate interposed between the header plate and the tube plate, while in another embodiment the stop surfaces are defined by portions of the surface of the header plate facing the tube plate.

Other objects and advantages will become apparent from the following specification taken in connection with the accompanying drawings.

Preferably, steps c), d) and f) are performed using headers in fluid communication with the tubes in the rows.

DESCRIPTION OF THE PREFERRED EMBODIMENTS

Figure 1:
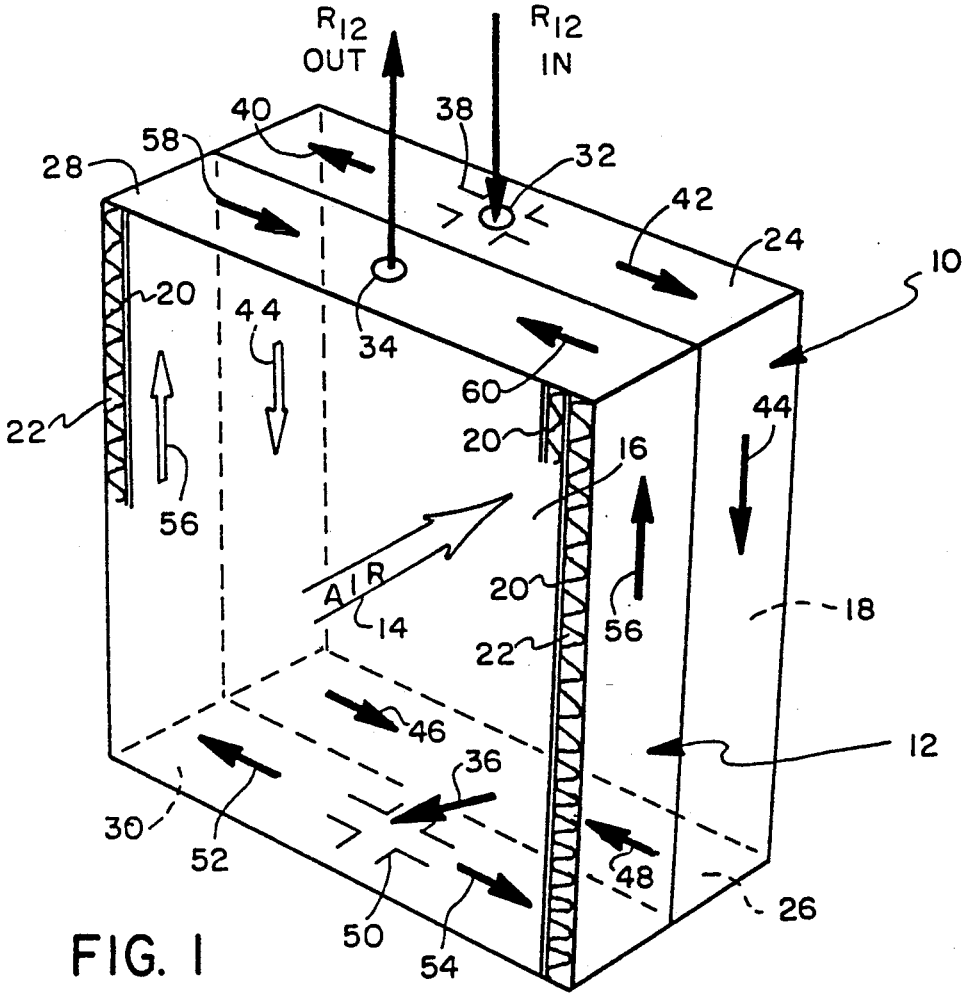
FIG. 1 is a schematic of a high efficiency evaporator construction made according to the invention and illustrating a preferred flow path.

Referring now to FIG. 1, a high efficiency, multiple pass evaporator is illustrated. While the same will be described as a two pass evaporator, it should be appreciated that additional passes may be added as required. Structure defining a first pass is generally designated 10 while structure defining a second pass is generally designated 12. The fluid to be cooled, usually air, is flowed through the evaporator in the direction of an arrow 14. Thus, a side 16 of the second pass 12 defines the front of the evaporator while a side 18 of the pass 10 defines the rear of the evaporator.

Generally speaking, each of the passes 10 and 12 will be made up of a plurality of elongated tubes 20 disposed in side by side, parallel relation with serpentine air side fins 22 extending between adjacent ones of the tubes 20. Typically, but not always, the fins 22 will be louvered, particularly where the fluid being cooled is in the gaseous phase, as opposed to the liquid phase.

The pass 10 includes an upper header shown schematically at 24 and a lower header shown schematically at 26. The second pass 12 includes an upper header 28 as well as a lower header 30.

At the midpoint of the upper header 24 for the first pass 10 which is, of course, the downstream pass, there is located an inlet for a refrigerant shown at 32. The upper header 28 of the second pass 12 includes an outlet 34. A refrigerant passage shown schematically at 36 establishes fluid communication between the lower header 26 of the first pass 10 and the lower header 30 of the second pass 12. It is to be specifically observed that the inlet 32, the outlet 34 and the passage 36 extend between locations intermediate the ends of the respective headers 24, 26, 28 and 30 and preferably, are located at the midpoints of the respective headers.

The inlet 32 includes a simple distributor shown schematically at 38 for the purpose of directing incoming refrigerant in diametrically opposite direction towards opposite ends of the header 24 as illustrated by arrows 40 and 42. This refrigerant will flow downwardly through the tubes 20 as illustrated by arrows 44. While the arrows 44 are illustrated as being near the ends of the first pass 10, such flow will be taking place across the entirety of the pass 10 from one end to the other.

Upon reaching the lower header 26 of the first pass 10, refrigerant flow within the header 26 is in the direction of arrows 46 and 48 toward the center of the header 26 and the fluid passage 36.

Upon reaching the fluid passage 36, the refrigerant flow then passes from the lower header 26 to the lower header 30. In some, but not all, instances, the passage 36 terminates within the header 30 in a distributor 50. The distributor 50, when present, acts just as the distributor 38 and directs the refrigerant in diametrically opposite directions toward opposed ends of the header 30 as indicated by arrows 52 and 54. The refrigerant then passes up through tubes 20 across the entire width of the pass 12 to the upper header 28. This flow is illustrated by arrows 56 and again it is to be specifically noted that such flow is occurring across the entirety of the pass 12 and not just through the end most ones of the tubes 20.

Upon reaching the upper header 28 for the pass 12, the refrigerant is directed toward the center thereof as illustrated by arrows 58 and 60 to emerge from the outlet 34.

It has been found that a multiple pass evaporator having the flow path just described provides excellent efficiency. Excellent uniformity of temperature from one location on the face 18 to another is achieved, thereby indicating high efficiency. Furthermore, actual testing of an embodiment of the invention illustrates marked superiority over other structures, both of the prior art as well as non prior art experimental designs.

Figure 2:
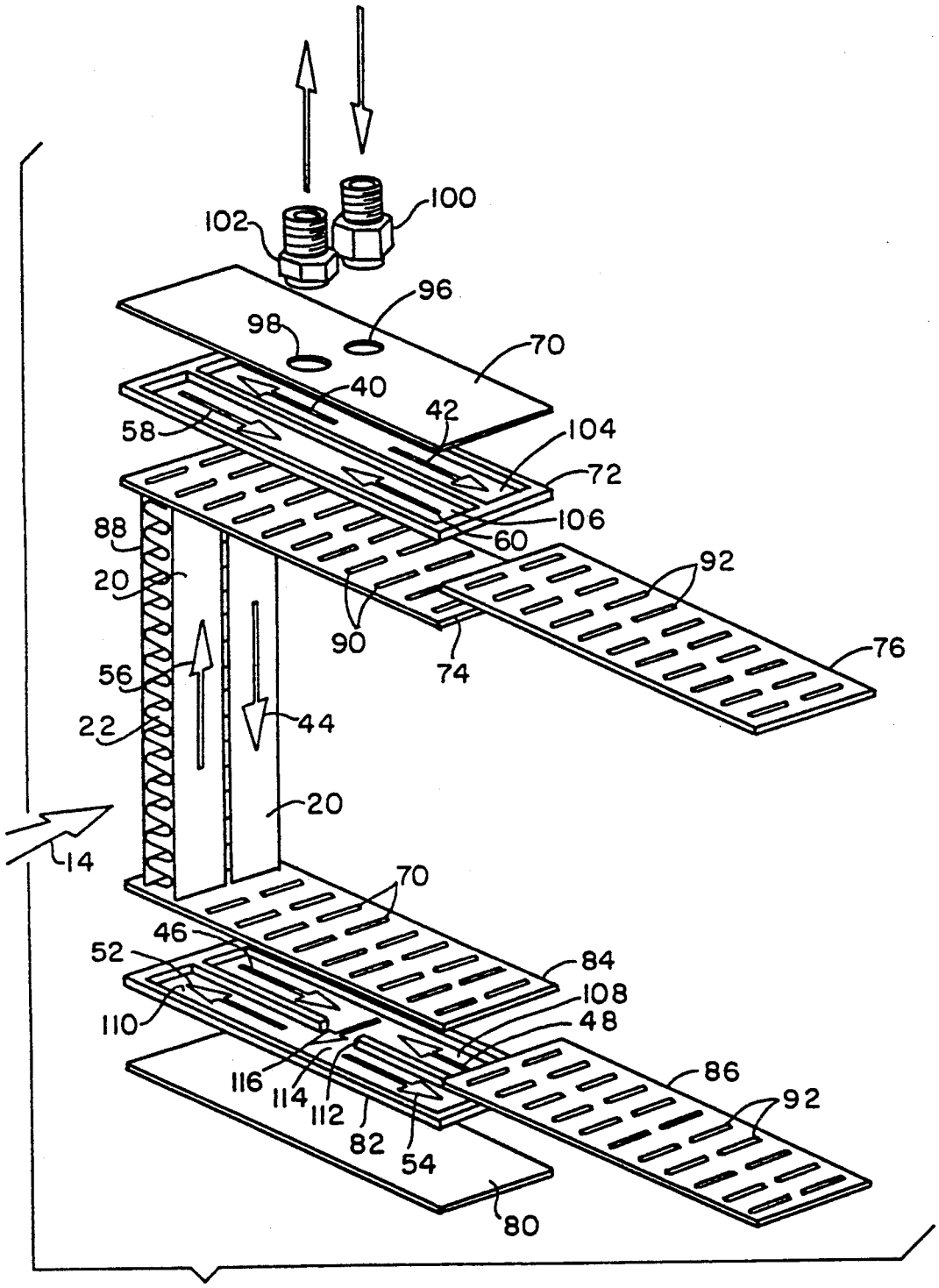
FIG. 2 is an exploded view of one embodiment of the high efficiency evaporator utilizing a laminated header construction.

To provide a low profile evaporator, the same may be constructed as shown in FIG. 2. More particularly, the upper headers 24 and 28 are formed of a single structure as are the lower headers 26 and 30. Further, each of the header structures is made of a series of plates forming a lamination wherein the plates, typically aluminum, are brazed together. Thus, the upper headers 24 and 28 may be made of three, and optionally, four plates including a cover plate 70, a header plate 72 and a tube plate 74. Optionally, a stop plate 76 may be employed. The cover plate 70 and the tube plate 74 sandwich the header plate 72 and the stop plate 76 when present.

The lower headers 26 and 30 are defined by three, and optionally, four plates including a cover plate 80, a header plate 82 and a tube plate 84 which may be identical to the tube plate 74. Optionally included is a stop plate 86 which may be identical to the stop plate 76.

In the preferred embodiment, the tubes 20 extend between the tube plates 74 and 84 in two or more rows and have the serpentine fins 22 located between adjacent tubes 20 in the same row and/or end pieces 88 defining the ends of the core as is well-known. The ends of the tubes 20 are snugly fitted within mating apertures 90 in the tube plates 74 and 84 and brazed therein. Thus, the tubes 20 will typically be formed of aluminum as well.

The stop plates 76 and 86 have a plurality of apertures 92 which, in the overall assembly, align with the aperture 90 in the tube plates 74 and 84. The stop plates 76 and 86 are located in their respective headers on the sides thereof remote from the tubes 20 and the apertures 92 are typically shaped and sized identically to the cross section of the interior of the tubes 22. That is to say, the apertures 92 will be smaller than the outer dimension of the tubes 20 by the wall thickness of the tubes 20. The stop plates 76 and 86 perform no functions other than positioning the tubes 20 as will be seen. thus, to conserve material expenses, the stop plates 76, 86 may be much thinner than, for example, the tube plates 74, 84.

With the stop tubes 76 and 86 in place, it will be appreciated that while the ends of the tubes 20 may enter the tube plates 74 and 84, they cannot pass through the tube plates 74 and 84 as they will be blocked by the stop plates 76 and 86 due to the reduced size of the apertures 92 therein. In many instances, however, use of the stop plates 76 and 86 is not necessary and the same may be dispensed with.

Returning now to the cover plate 70, the same includes an inlet aperture 96 and an outlet aperture 98. A combination inlet fitting/distributor 100 which serves the function of the distributor 38 described in connection with FIG. 1 as well as a connecting point for tubing forming part of the refrigeration system is disposed in the opening 96 and brazed therein. An outlet fitting 102 is located in the opening 98.

The header plate 72 includes two elongated cut outs 104 and 106 which are aligned with the apertures 90 which in turn are in plurality of rows equal to and aligned with the rows of the tubes 20. Thus, the flow represented by the arrows 40 and 42 as described in FIG. 1 occurs within the cut out 104 while the flow associated with the arrows 58 and 60 occurs in the cut out 106. The cut outs 104 and 106 thus serve to establish fluid communication respectively within the inlet 96 and the outlet 98 and the open ends of the tubes 20 in two adjacent rows.

The header plate 82 includes a pair of cut outs 108 and 110 which are elongated and which are respectively aligned with the two rows of apertures 90 representing the two different passes. A central partition 112 separates the cut outs 108 and 110 and includes a central opening 114 which functions as the passage 36 described in FIG. 1. Thus, flow associated with the arrows 46 and 48 as previously described occurs in the cut out 108 while the transfer of the flow from the first pass to the second pass occurs through the opening 114 as shown by an arrow 116. Flow associated with the arrows 52 and 54 occurs in the cut out 110. The cover plate 80, of course, serves to seal the side of the header plate 82 oppositely of the tube plate 84.

Figure 3:
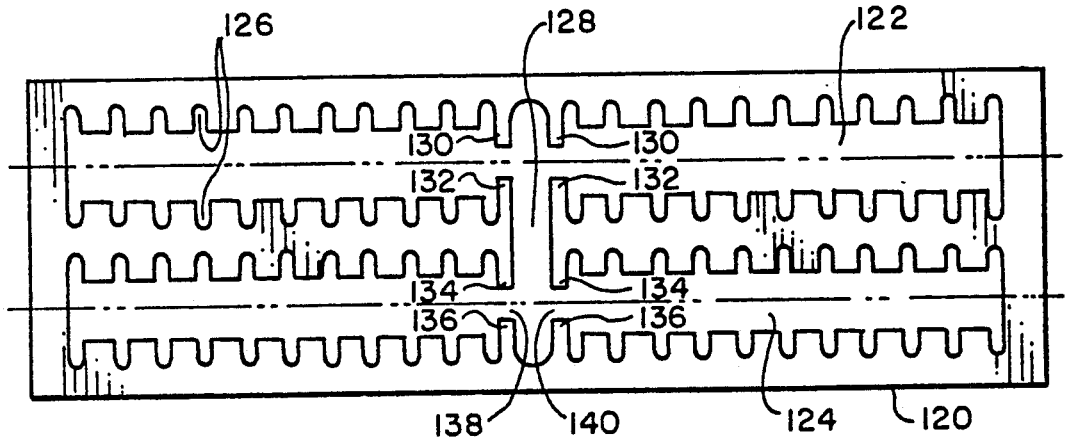
FIG. 3 is a plan view of a modified embodiment of a collector and distributor plate that may be used in the embodiment of FIG. 2.

In some instances, it may be desirable to direct the refrigerant towards opposite ends of the lower header 30 of the second pass after it emerges from the passage 114 as noted previously. In this case, a header plate 120 shown in FIG. 3 may be substituted for the header plate 82. This header plate includes elongated channels 122 and 124 which correspond approximately to the cut outs 108 and 110 in the header plate 82. They are, however, somewhat narrower and in order to allow free egress from or entry into aligned tube ends, at the locations where alignments with the tubes will occur, notches 126 are located. In some cases, the notches 126 may have a size and shape identical to the size and shape of the interior of the tubes 20. Thus, the resulting openings will be too small to allow the tube ends to pass into the channels 122 and 124 and the stop plate 86 may be eliminated.

To provide the effect of the fluid passage 114, the plate 120 is provided with a central passage 128 interconnecting the channels 122 and 124. The plate 120 includes opposed projections 130 and 132 on opposite sides of the passage 128 at its intersection with the channel 122. Similar projections 134 and 136 are located at the intersection of the fluid passage 128 in the channel 124 and together define opposed outlet openings 138 and 140 which open toward opposite ends of the channel 124 to thereby provide the structure defining the distributor 50 (FIG. 1). Thus, when the plate 120 is used, a between pass distributor construction is provided.

Figure 4:
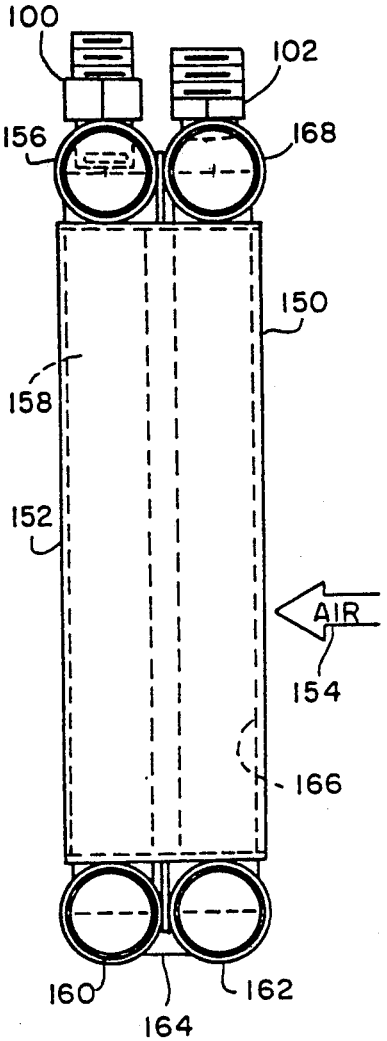
FIG. 4 is a side elevation of a modified embodiment of the high efficiency evaporator and utilizing tubes as headers.

FIG. 4 illustrates an alternative embodiment wherein the various headers are defined by cylindrical tubes. The front of the evaporator is illustrated at 150 and the rear illustrated at 152. Air flow is in the direction of an arrow 154. An inlet header 156 is provided with the inlet fitting 100. A plurality of parallel tubes 158 extend from the inlet header 156 to a tubular header 160 which corresponds to the header 26 in FIG. 1. Adjacent to the header 160 is another tubular header 162 corresponding to the header 30 in FIG. 1 and a central jumper tube 164 interconnecting the headers 160 and 162 at their midpoints serves to define the passage 36 (FIG. 1).

Flattened tubes 166 extend from the header 162 to a tubular outlet header 168 provided with the outlet fitting 102. Serpentine fins will be located between the tubes 158 and 166 as is well-known and the structure will be generally as in commonly assigned U.S. Pat. No. 4,829,780 issued May 16, 1989 to Hughes, et al., the details of which are herein incorporated by reference.

Figure 5:
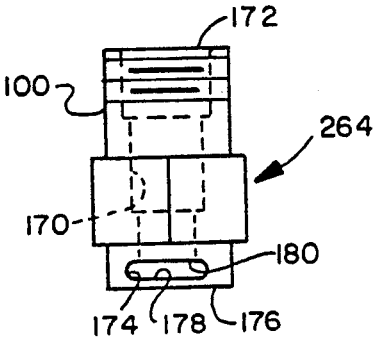
FIG. 5 is a side elevation of an inlet fitting that may be used with any of the embodiments of the invention.
Figure 6:
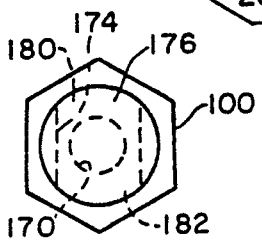
FIG. 6 is a view of the inlet fitting from the bottom thereof.

A preferred form of the inlet fitting 100 is illustrated in FIGS. 5 and 6. The same is seen to include a generally axial passage 170 extending from the threaded end 172 of the fitting 100 to a radial passage 174 closely adjacent an end 176 of the fitting 100 opposite the threaded end thereof. As can be seen in FIGS. 5 and 6, the radial passage 174 is in the configuration of a flattened oval and thus presents an impingement surface 178 to the axial passage 170. It will also be observed, particularly from FIG. 5, that the radial passage 174 is wider than the axial passage 170 and terminates in opposed openings 180 and 182 which are diametrically opposite of one another.

When the fitting 100 is assembled to either the tube 156 or the cover plate 70, the arrangement is such that the openings 180 and 182 are disposed within the cut out 104 or the interior of the tubular header 156 with the radial passage 174 parallel to the longitudinal axis thereof. Thus, the openings 180 and 182 will face opposite ends of the header structure in which they are received so as to provide refrigerant flow and distribution as illustrated by the arrows 40 and 42 (FIGS. 1 and 2).

Figure 7:
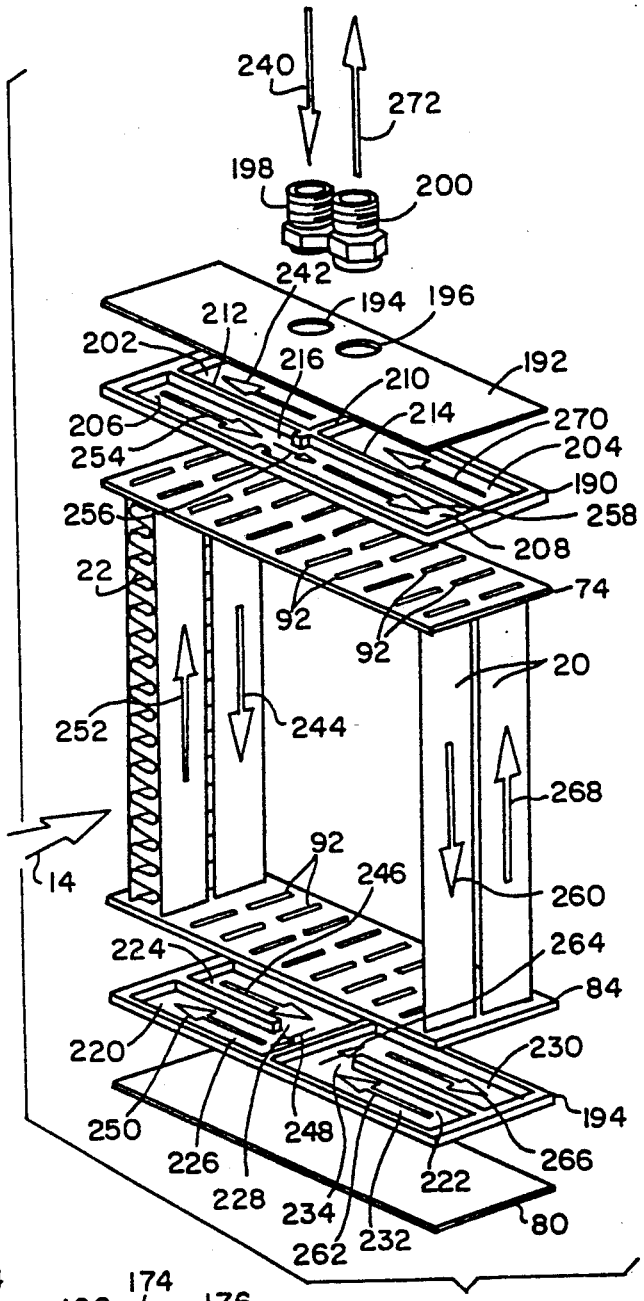
FIG. 7 is a view similar to FIG. 2 but of a modified embodiment of the invention.

Turning now to FIG. 7, a modified embodiment of an evaporator will be described. Generally speaking, evaporators embodying the flow regimen described in connection with FIG. 1 are the preferred embodiments of evaporators made according to the invention. However, improved results over conventional evaporators may also be achieved with the flow regimen provided by the embodiment illustrated in FIG. 7.

In the interest of brevity, in the following description of FIG. 7, components previously described will be given the same reference numerals and will be redescribed only to the extent necessary to fully appreciate the manner of operation of the embodiment of FIG. 7.

The evaporator of FIG. 7 may include a core including tube plates 74 and 84 with flattened tubes 20 and serpentine fins 22 extending therebetween in the manner mentioned previously. There are thus two rows of the tubes 20.

An upper header for the evaporator includes the tube plate 74, a header plate 190 and a cover plate 192. A lower header is defined by the tube plate 84, a header plate 194 and a cover plate 80 identical to that described in the description of FIG. 2. Stop plates (not shown) can be used if desired.

The cover plate 192 associated with the upper header includes an inlet opening 194 and an outlet opening 196. Unlike the openings 96 and 98 in the embodiment of FIG. 2 which are associated with two different rows of the tubes 20, the openings 194 and 196 of the embodiment of FIG. 7 are both aligned with the rearmost row of the tubes 20. Inlet and outlet fittings 198 and 200, respectively, of any desired construction, may be brazed to the cover plate 192 within the openings 194 and 196.

The header plate 190 includes four cut outs 202, 204, 206 and 208. The cut outs 202, 204, 206, 208 are elongated, but extend only about half the length of the header plate 190. Further, the cut outs 202 and 204 are separated from each other by a web 210 and are located so as to overlie the tube openings 92 receiving the rearmost row of tubes 20 taken in the direction of air flow.

The cut outs 202 and 206 are side-by-side, but separated by a web 212. Similarly, a web 214 separates the cut outs 204 and 208. The cut outs 206 and 208 are aligned with and overlie the tube openings 92 in the tube plate 74 aligned with the forwardmost or upstream row of tubes 20 considered in the direction of air flow represented by the arrow 14. An interrupted web 216 separates the cut outs 206 and 208 and for all intents and purposes, the interrupted web 216 acts much like the opposed projections 134 and 136 described in connection with the header plate 120. They allow directionalized flow from cut out 206 to the cut out 208.

The header plate 194 includes two U-shaped cut outs 220 and 222. The cut out 220 has one leg 224 which underlies the tube openings 92 for the downstream row of the tubes 20 whose opposite ends open to the cut out 202. The other leg 226 of the cut out 220 is aligned with the tube openings 92 in the upstream row of the tubes 20 whose opposite ends open to the cut out 206.

The bight 228 of the cut out 220, of course, establishes fluid communication between the legs 224 and 226.

One leg 230 of the U-shaped cut out 222 is aligned with the tubes 20 in the downstream row which also open to the cut out 204 while the other leg 232 opens to the tubes 20 in the upstream row which also open to the cut out 208. And again, the bight 234 connecting the legs 230 and 232 establishes fluid communication between the two.

From the foregoing, it will be appreciated that, as viewed in FIG. 7, refrigerant flow will be from back to front on the left hand side of the evaporator and from front to back on the right hand side of the evaporator. More specifically, incoming refrigerant illustrated schematically by an arrow 240 will enter the upper header defined by the plates 74, 190 and 192 at the opening 194 which is near the center thereof and be directed in the direction of an arrow 242 towards an end thereof. The refrigerant will flow downwardly through the left hand half of the downstream row of the tubes 20 as illustrated by an arrow 244 to enter the leg 224 of the cut out 220. Within the leg 224, refrigerant flow will be generally in the direction of an arrow 246 and across the bight as shown by an arrow 248 to flow within the leg 226 in the direction illustrated by an arrow 250. This will result in distribution of the refrigerant to the tubes 20 in the upstream row thereof on the left hand half of the evaporator as illustrated by an arrow 252. The refrigerant thus flowing will be collected in the cut out 206 and will flow generally in the direction of an arrow 254 through the broken web 216 as shown by an arrow 256 where the flow will be directionalized to enter the cut out 208 and flow generally in the direction of an arrow 258.

The refrigerant will then enter the right hand tubes 20 in the upstream row thereof and flow downwardly through such tubes in the direction of an arrow 260 to enter the leg 232 of the cut out 222. In the leg 232, flow will be in the direction of an arrow 262 toward the bight 234. Within the bight 234, flow will be in the direction of an arrow 264 toward the leg 230 where flow will be in the direction of an arrow 266. This flow will, of course, enter the right hand half of the tubes 20 in the downstream row thereof and flow upwardly within such tubes in the direction of an arrow 268 to enter the cut out 204. Within the cut out 204, flow will be in the direction of an arrow 270 to the outlet opening 196 to the outlet fitting 200 to emerge therefrom in the direction of an arrow 272.

It is highly preferable that the tubes extending between headers in the various embodiments be divided into a plurality of passages, each of relatively small hydraulic diameter. Suitable tubes will typically have passages with hydraulic diameters in the range from about 0.015 to 0.070 inches, although precise values may vary somewhat depending upon other parameters including, but not limited to, the choice of refrigerant. Such tubes may be made according to the method described and claimed in commonly assigned U.S. Pat. No. 4,688,311 issued Aug. 25, 1987 to Saperstein, et al. and entitled "Method Of Making A Heat Exchanger", the details of which are herein incorporated by reference. Alternatively, tubes of flattened cross-section with individual passages having relatively small hydraulic diameter made by extrusion may be useful.

Tests have shown that a two pass evaporator made according to the invention provides excellent heat transfer equal to or better than so-called serpentine evaporators currently employed in automotive air-conditioners. Typically, the serpentine evaporators have a front to back dimension 50% greater than one made according to the invention and typically may have an air side pressure drop on the order of 30% greater than an evaporator made according to the invention. The same is believed to be true for other types of evaporators, such as drawn cup or plate fin-round tube evaporators. As a consequence, an evaporator according to the present invention will occupy a lesser space because of its lesser depth and generally will have less weight than a prior art evaporator because of its smaller size. As is widely recognized, reduced weight is an important factor in achieving greater fuel economy.

In addition, the fact of a reduced air side pressure drop means that in, for example, an automotive airconditioning system, a smaller motor may be utilized in driving the fan which flows the air through the evaporator. The use of a small motor allows a reduction in cost and even more importantly a reduction energy requirements and thus provides an improvement in fuel economy.

Other like advantages provided by the invention will be readily apparent to those skilled in the art.

I claim:

1. An evaporator for a refrigerant comprising:

at least two elongated rows of refrigerant passages having opposed ends, the first of said rows defining the front of the evaporator and the last of said rows defining the rear of the evaporator;

means defining at least four elongated header passages, two for each of said rows, one at each of the said ends in each of the rows, and in fluid communication with the refrigerant passages of the associated row, the header passages at corresponding ends of said rows being adjacent to one another;

an inlet to one of said header passages in said last row and intermediate the ends thereof;

an outlet from another of said header passages in said first row and intermediate the ends thereof; and at least one fluid passage extending between pairs of each of the remaining header passage and intermediate the ends thereof, each pair being made up of two immediately adjacent header passages.

2. The evaporator of claim 1 wherein said inlet includes a receiving passage extending generally normal to an impingement surface and adapted to receive a refrigerant to be evaporated, and a pair of discharge openings spaced 180° apart and at the intersection of said impingement surface and said receiving passage and generally transverse to said receiving passage, said discharge openings facing down opposite sides of said one header passage.

3. The evaporator of claim 1 wherein said header passages are defined by tubes.

4. The evaporator of claim 1 wherein said header passages are defined by laminations.

5. The evaporator of claim 1 wherein each of said fluid passages has an outlet from one header passage of a pair and an inlet to the other header passage of a pair and each said inlet includes two diametrically opposite discharge openings intermediate the ends of the associated header passage and facing down opposite sides thereof.

6. The evaporator of claim 1 wherein said inlet is at the midpoint of said one header passage.

7. The evaporator of claim 1 wherein said fluid passages extend between the midpoints of the header passages in a pair.

8. An evaporator comprising:

two spaced header structures, each having two elongated interior header passages;

a plurality of flattened tubes extending between said header structures defining two rows with each row being in fluid communication with a corresponding header passage in each header structure;

an inlet to one of said header passages in one of said header structures located generally centrally relative to the ends of said one header passage;

an outlet from the other of said header passages in said one header structure located generally centrally relative to the ends of said other header passage; and a connecting passage extending between the header passages in the other of said header structures located generally centrally relative to the ends of said header passages in said other header structure.

9. The evaporator of claim 8 wherein said inlet is defined by a fitting having an axial passage terminating in a flat surface and a radial passage terminating in opposed discharge openings, said flat surface being part of the wall of said radial passages.

10. The evaporator of claim 9 wherein said radial passage is of flattened cross section.

11. The evaporator of claim 10 wherein the width of said radial passage is greater than the width of said axial passage.

12. The evaporator of claim 8 wherein the tubes in one row are separate from the tubes in the other row.

13. A method of cooling a fluid stream comprising the steps of:

a) flowing the stream of fluid to be cooled in a particular path and a particular direction;

b) placing at least two elongated rows of refrigerant passages across said path;

c) introducing refrigerant into the refrigerant passages of a row that is downstream in relation to said particular direction from the general center of the downstream row toward at least one end thereof;

d) collecting the refrigerant as it emerges from the refrigerant passages of said downstream row and introducing it into the refrigerant passages in the immediately upstream row at its general center and toward at least one end thereof;

e) sequentially repeating steps c) and d) until the refrigerant has passed through all of said rows; and f) collecting the refrigerant as it emerges from the most upstream row.

14. The method of claim 13 wherein steps c), d) and f) are performed using headers in fluid communication with the refrigerant passages in said rows.

15. The method of claim 13 wherein step c) includes introducing the refrigerant in diametrically opposite directions.

16. The method of claim 13 wherein step d) includes introducing the refrigerant in diametrically opposite directions.

17. The method of claim 13 wherein step f) includes returning the refrigerant to the downstream row in a stream isolated from stream of refrigerant resulting from step c), d) and e).

18. The method of claim 13 wherein steps c) and d) include introducing the refrigerant in diametrically opposite directions.

* * * * *